US005081329A

United States Patent [19]

Mitusinski et al.

[11] Patent Number: 5,081,329

[45] Date of Patent: Jan. 14, 1992

[54] KEY ASSEMBLY, SWITCH ASSEMBLY AND METHOD OF MAKING SAME

[75] Inventors: Leszek Mitusinski, Waterbury; James A. Iannone, Stratford, both of Conn.

[73] Assignee: TIE Communications, Inc., Seymour, Conn.

[21] Appl. No.: 581,842

[22] Filed: Sep. 13, 1990

[51] Int. Cl.[5] ..... H01H 9/18

[52] U.S. Cl. ..... 200/314; 200/512

[58] Field of Search ..... 200/314, 512, 345

[56] References Cited

U.S. PATENT DOCUMENTS 4,343,975 8/1982 Sado ..... 200/314

4,924,044 8/1990 Takahashi et al. ..... 200/314

*Primary Examiner*—Renee S. Luebke

*Attorney, Agent, or Firm*—Amster, Rothstein & Ebenstein

[57] ABSTRACT

A switch assembly has a back-lit key assembly including an opaque plug, a transparent body lightable from below at least partially to one side of the plug, and a transparent fusing member securing the transparent body and opaque plug together with the fusing member for movement as a unit. A flexible, transparent keypad is secured beneath the key assembly for movement therewith. An electrical contact is secured to the keypad for movement therewith. A board may be disposed at least partially beneath the keypad, the board including a light source disposed at least partially beneath the keypad to illuminate the transparent body and an open electrical circuit adapted to be closed by the electrical contact when the keypad is flexed downwardly.

20 Claims, 4 Drawing Sheets

KEY ASSEMBLY, SWITCH ASSEMBLY AND METHOD OF MAKING SAME

BACKGROUND OF THE INVENTION

The present invention relates to a key assembly, a switch assembly, and a method of making the same, and, more particularly, to a switch assembly having a back-lit key assembly including opaque and transparent members.

Prior art switch assemblies including opaque and transparent members typically have one of these members movable and the other stationary. Frequently, the transparent member was stationary and, when lit from below, indicated that the opaque member should be manually actuated (for example, by depression). The disadvantages of the conventional switch assembly are obvious. At least two separate members (one the opaque member, and one the transparent member) must be placed in the final panel containing the switch assembly. Additionally, the panel must be formed with separate apertures for the two members, and these apertures must be sufficiently spaced from other pairs of apertures so that it is clear which opaque member is to be actuated in response to the signal of a given transparent member. Alternatively the two separate members may be formed in a two stage plastic injection molding process (commonly called a "double shot" molding process), but this is an expensive procedure which results in a rigid key subassembly.

Accordingly, it is an object of the present invention to provide a switch assembly wherein the opaque and transparent members of the key assembly are secured together for movement as a unit.

Another object is to provide such a switch assembly which is compact, yet is clear as to which of a plurality of opaque members is to be depressed in response to the lighting of one of a plurality of transparent members.

A further object is to provide such a switch assembly enabling closer disposition of the plurality of switch assemblies on a given panel of switch assemblies.

It is an object of the present invention to provide such a switch assembly which is economical to manufacture and of sturdy, rugged construction.

It is also an object to provide such a key assembly by itself.

It is a further object to provide a safe, effective and economical method of manufacturing such a key assembly.

SUMMARY OF THE INVENTION

It has now been found that the above and related objects of the present invention are obtained in a switch assembly comprising a back-lit key assembly, a flexible transparent keypad secured to the key assembly for movement therewith, and an electrical contact secured to the keypad for movement therewith. The key assembly includes an opaque member, a transparent member lightable from below at least partially to one side thereof, and a transparent fusing member securing the transparent and opaque members of the key assembly together for movement as a unit.

In a preferred embodiment, the opaque member includes a recess opening downwardly and to the one side, and the fusing member includes an upwardly extending lug occupying the recess. The electrical contact is disposed beneath the opaque member. The transparent member defines a belt at the bottom thereof extending about a cross-section of the bottom of the opaque member, the outer surface of the belt being flush with the outer surface of the opaque member. The key assembly and the keypad are rubber.

The present invention also encompasses the key assembly by itself and the combination of the switch assembly and a circuit board (also called a board) wherein the board is disposed at least partially beneath the keypad and the electrical contact. The board is preferably opaque and includes a light source disposed directly beneath the transparent member to illuminate the transparent member and an open electrical circuit adapted to be closed by the electrical contact when the keypad is flexed downwardly. The light source may be a light-emitting diode, and the electrical contact is disposed beneath the opaque member.

The present invention further encompasses a method of making the key assembly comprising the steps of providing a back-lit key subassembly having an opaque member and a transparent member lightable from below at least partially to one side thereof. Atop the inverted key assembly a transparent fusing member is molded so that a portion of the molten material of the fusing member flows intermediate the opaque and transparent members of the key subassembly to secure the transparent and opaque members of the key assembly together and to the fusing member for movement as a unit.

In a preferred embodiment, the opaque member includes a recess opening downwardly and to the one side and, during the molding step, a portion of the molten material of the fusing member is permitted to flow downwardly into the recess of the inverted key subassembly to secure the transparent and opaque members of the key subassembly together and to the fusing member. The transparent member defines a belt extending about a cross-section cf the opaque member adjacent the bottom thereof, and, during the molding step, the belt prevents the molten material of the fusing member from extending laterally outwardly of the belt.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
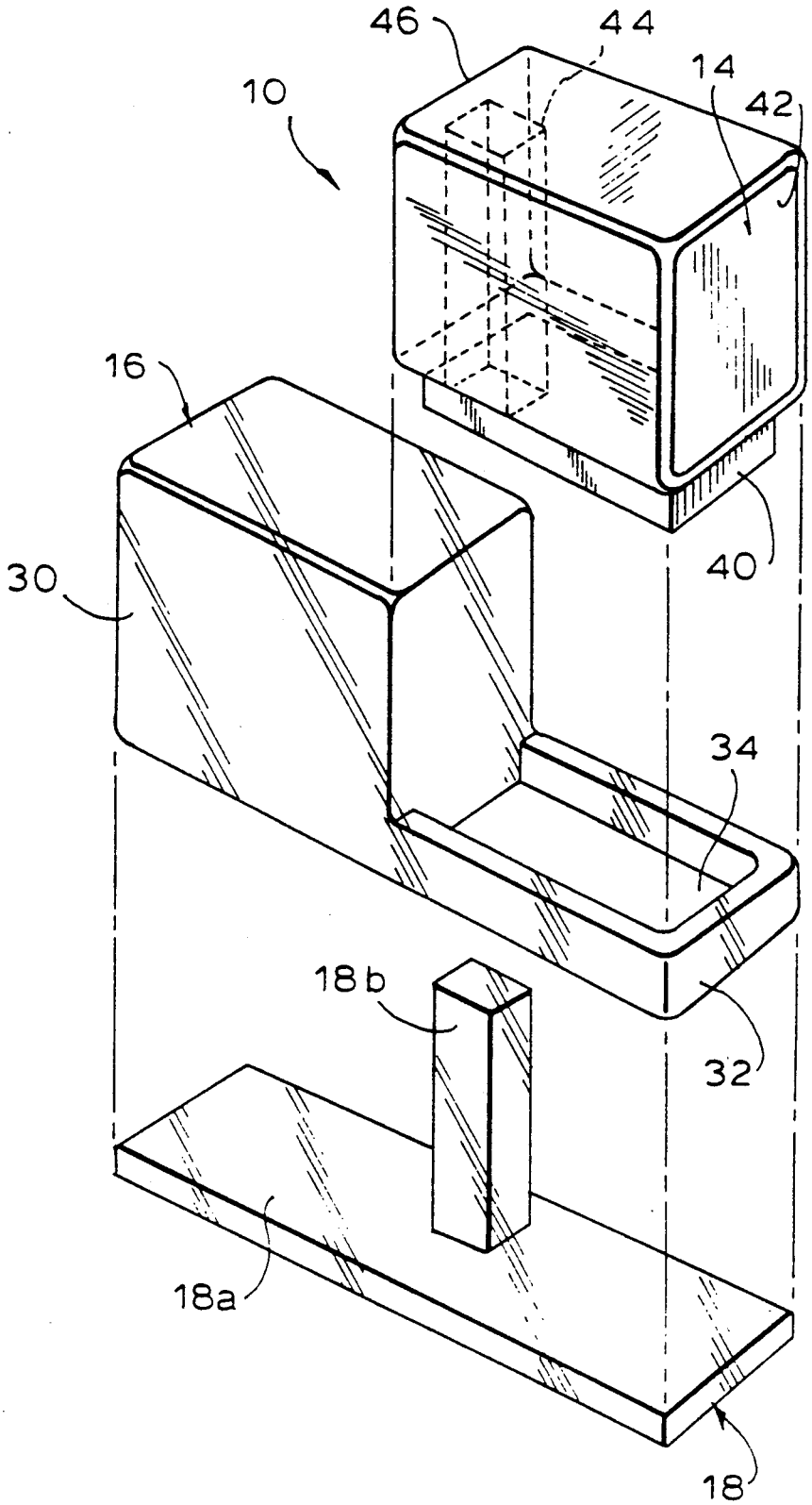
FIG. 1 is an isometric view of a key assembly according to the present invention.
Figure 2:
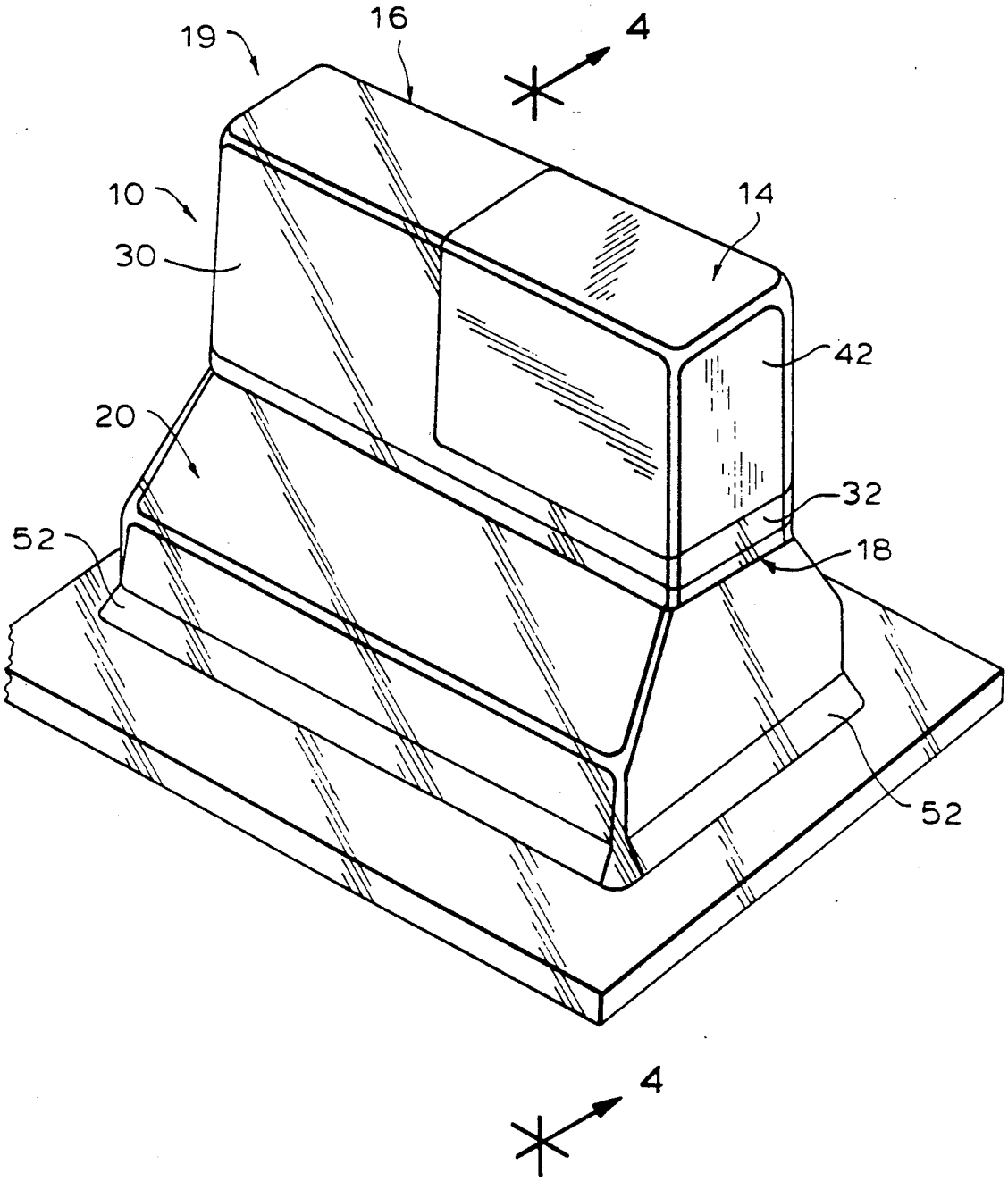
FIG. 2 is an isometric view of a switch assembly according to the present invention.
Figure 3:
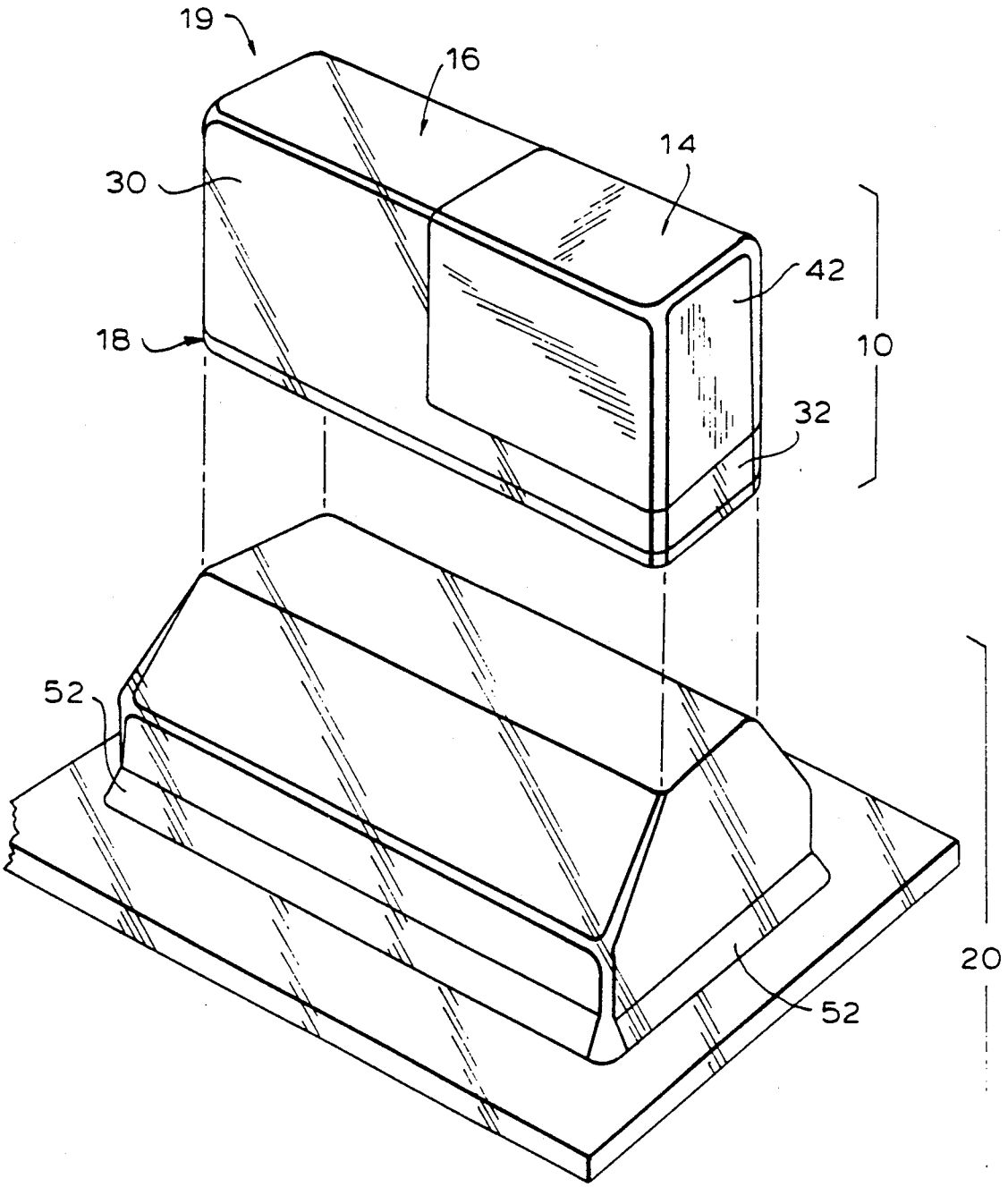
FIG. 3 is an exploded isometric view thereof.
Figure 4:
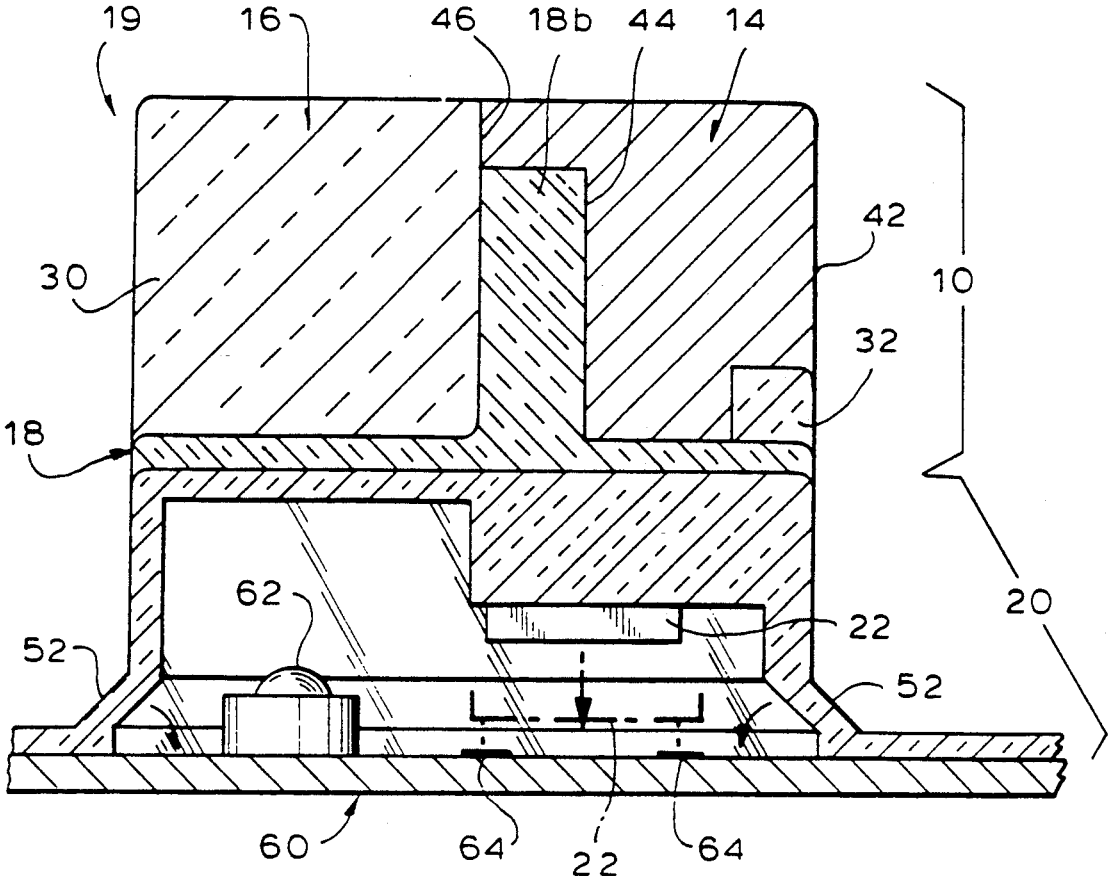
FIG. 4 is a sectional view thereof with a board, taken along the line 4—4 of FIG. 2.

Referring now to the drawing, and in particular to FIG. 1 thereof, therein illustrated is a key assembly according to the present invention, generally designated by the reference numeral 10, adapted for partial illumination from below. In its basic aspects, the key assembly 10 includes an opaque member or plug generally designated 14, a transparent body generally designated 16 disposed at least partially to one side thereof, and a transparent fusing member generally designated 18 fusing together the plug 14 and body 16. Referring now to FIGS. 2-3, therein illustrated is a switch assembly 19 according to the present invention including a flexible, electrically insulative keypad, generally designated 20, disposed at least partially beneath and secured to the key assembly 10 for movement as a unit. Referring now to FIG. 4 as well, an electrical contact 22 is secured to the bottom of keypad 20 for movement therewith and for closing a circuit on which the keypad 20 is mounted.

It will be appreciated that the term "transparent," as used herein and in the claims includes both light-transmitting and translucent materials which permit the viewer to ascertain whether or not the members made therefrom are being illuminated from below.

Referring now to FIG. 1, therein illustrated is the key assembly 10 by itself. The transparent (or optionally translucent) body 16 and the opaque plug 14 of the key subassembly are pre-molded separately—e.g., by conventional compression molding. The transparent body 16 includes a body portion 30 and a laterally extending belt portion 32. The body portion 30 is of generally box-like configuration, although the upper edges thereof may be rounded for the comfort of the user. The body portion 30 is preferably solid, as shown, but may be hollow if it is substantially fluid-tight so that opaque material cannot enter the interior thereof during the manufacturing process to be described hereinbelow. The belt portion 32 is shorter (i.e., of less height) than the body portion 30 and, in conjunction with one wall of the body portion 30, defines an aperture 34 configured and dimensioned to receive therein and therethrough a lower portion 40 of the plug 14.

The opaque plug 14 includes a lower portion 40 and an upper portion 42. The plug upper portion 42 is of generally box-like configuration, although the upper edges thereof may be rounded for the comfort of the user. Preferably the external dimensions of the plug upper portion 42 are substantially equal to the corresponding dimensions of the body portion 30 of the body 16, and the tops, the fronts, and the backs of the plug upper portion 42 and body portion 30 are preferably flush, as shown. The plug lower portion 40 is preferably of reduced dimensions (i.e., length and width) relative to the plug upper portion 42 and fits rather snugly into aperture 34 so as to maintain the plug 14 and body 16 in close proximity during the manufacturing process, with the body 16 being at least partially to one side of the plug 14. For reasons which will become apparent hereinafter, the plug 14 defines a recess 44 extending upwardly through the lower portion 40 and into (but not through) the upper portion 42 thereof. The recess 44 is spaced from three sides of the plug 14, but forms a part of the side 46, which will abut the body 16 in the key assembly 10.

The key assembly 10 additionally includes a transparent fusing member 18 which extends over the bottom thereof, thus covering the bottom of the body portion 30 and belt 32 of the transparent member 16 as well as the bottom 40 of the plug 14. The fusing member 18 includes a very thin, typically planar body portion 18*a* and an upstanding lug portion 18*b*. The upstanding lug portion 18*b* extends upwardly into the recess 44 to secure the opaque plug 14 and transparent body 16 of the key assembly 10 together (because the portion of the lug 18*b* in the recess 44 extending through the plug surface 46 contacts the abutting surface of the body portion 30 of body 16) and to the fusing member 18 (as a result of the contact between the bottom surfaces of bottom portion 40 of plug 14 and the body portion 30 and belt portion 32 of bottom 16), each of these three members being secured together for movement as a unit.

It will be appreciated that the belt 32 at the bottom of the transparent body 16 and extending about the plug bottom portion 40 is disposed intermediate a downwardly-facing surface of the plug upper portion 42 and an upwardly-facing surface of the fusing member 18. The outer surface of the belt 32 is preferably flush with the outer surface of the plug upper portion 42.

Referring now to FIGS. 2 and 3, therein illustrated is the switch assembly 19 wherein a flexible, electrically insulative, transparent keypad 20 is secured beneath the key assembly 10. Typically, the keypad 20 is molded onto the top of a plurality of inverted key assemblies 10 to fix the key assemblies 10 to the keypad 20. Thus, the two molding steps not only secure the members 14, 16 of each key assembly 10 together (in the first step), but also secure them to the keypad 20 itself (in the second step). While only the portion of the keypad 20 in the immediate vicinity of a single key assembly 10 has been illustrated in switch assembly 19, it will be appreciated that the keypad 20 may be of conventional design including a plurality of key assemblies 10, surrounding backing, and the like.

The keypad 20 is substantially open at the bottom thereof (as best seen in FIG. 4), with the electrical contact 22 being secured to the keypad 20, and preferably a downwardly-facing surface thereof, in alignment with the opaque plug 14. Accordingly, the conductive contact 22 need not be transparent and may be opaque. A preferred material for the conductive contact 22 is carbon-impregnated rubber.

Preferably the thin sidewalls 52 of the hollow keypad 20 are beveled outwardly adjacent the bottom thereof to facilitate resilient vertical (i.e., downward) flexing of the keypad 20 towards a substrate. The precise configuration of the keypad 20 is not critical so long as its configuration, dimensions, and material provide sufficient resilient flexibility to allow vertical movement of the conductive contact 22 secured thereto under downward manual pressure and then its return to the original raised position after release of the downward pressure.

Referring now to FIG. 4 in particular, the switch assembly 19, as described hereinabove, is adapted to be mounted on a board, generally designated 60, so that the board 60 is disposed at least partially beneath the keypad 20 and the electrical contact 22. The board 60, which may be of printed circuit design, includes a light source 62 disposed at least partially beneath the keypad 20 and preferably directly aligned with the transparent body 16 of the key assembly 10. A preferred light source 62 is a light-emitting diode, although clearly any of the conventional light sources may be used. The board 60 additionally includes an open electrical circuit, indicated by the electrodes 64, adapted to be temporarily closed by the electrical contact 22 when the switch assembly 19 is flexed downwardly (thereby flexing the keypad 20 and causing the electrical contact 22 to come into contact with both of the electrodes 64 in vertical alignment therewith). The electrodes 64 may be formed of any electrically conductive material and are preferably gold or carbon contacts. The circuit which is closed when the electrodes 64 are in electrical contact through the electrical contact 22 will depend upon the particular application intended to be controlled by the switch assembly 19 and hence is not further shown herein. It will be appreciated, however, that the circuit may in fact at least partially control the light source 62 so that closing of the circuit energizes or de-energizes the light source 62, as desired.

The present invention further encompasses a method of making the key assembly 10 in a safe, economical manner to produce an aesthetically acceptable product of sturdy and rugged construction. Referring now to FIG. 1, the two main elements of the key assembly 10—i.e., the opaque plug 14 and the transparent body 16—are disposed side-by-side as a subassembly with the belt 32 of body 16 passing about the reduced size lower portion 40 of plug 14. The subassembly is then inverted (that is, turned upside down), placed in a conventional mold and covered with the material 18 with which they will be fused. Heat and/or pressure are applied to the materials within the mold, as necessary for the particular fusing material 18 involved, in order to fuse the fusing material 18 so that the molten material thereof can flow into the recess 44 of plug 14 and fill the same to form lug **18*b*, thereby securing the plug 14 and body 16 together for movement as a unit. The lug 18*b* is, accordingly, formed during the molding process. During this molding operation, the belt 32 prevents the molten material of fusing member 18 from flashing out between the two members 14, 16 of the key assembly 10**, thus marring the cosmetics of the finished product.

The various elements 14, 16, 18 of the key assembly 10 are formed of standard silicone contact mat rubber, preferably having a hardness of 35–80 using a Shore A durometer and a specific gravity of 1.1–1.4. The keypad 20 is formed of the same material. The material used for the opaque plug 14 is colored for opacity.

The molding operations employed in the formation of the key and switch assemblies may utilize conventional compression molding tooling, utilizing 40 Rockwell ISO S-50C tool steel. A first mold produces the respective main elements of the key assembly 10 (that is, the opaque plug 14 and transparent member 16 forming the key subassembly), a second mold creates the completed key assembly 10 (including the fusing member 18), and a third mold creates the switch assembly 19 (including the keypad 20). The molding processes utilize the conventional parameters used in silicone contact mat production, varying with mat size and the number of cavities in a mold—for example, 200°–250° C. temperature, 100–250 tons pressure, and cycle times of 10–15 minutes. As the opaque plug 14 and the transparent member 16 are separately molded (although optionally using different cavities of the same mold), each may be differently colored or made of different hardnesses in order to produce the desired pattern of a dual colored or dual hardness key.

While various members have been described above as being "transparent," clearly other light-transmitting members may be used instead, including translucent members.

To summarize, the present invention provides a switch assembly wherein the opaque and transparent members of the key assembly are secured together for movement as a unit so that the switch assembly is compact yet clear as to which of a plurality of opaque members is to be depressed in response to lighting of one of the plurality of transparent members. Accordingly, the switch assembly enables closer disposition of the plurality of switch assemblies on a given panel while providing a switch assembly which is economical to manufacture and of sturdy, rugged construction. Additionally, the invention provides a key assembly by itself and a method of manufacturing such an assembly which is safe, effective and economical.

Now that the preferred embodiments of the present invention have been shown and described in detail, various modifications and improvements thereon will become readily apparent to those skilled in the art. Accordingly, the present invention is to be construed broadly and limited only by the appended claims, and not by the foregoing disclosure.

We claim:

1. A switch assembly comprising:

(A) a back-lit key assembly having first and second opposed ends and including (i) an opaque member, (ii) a light-transmitting member lightable from said first end disposed at least partially to one side of said opaque member, and (iii) a light-transmitting fusing member securing said light-transmitting and opaque members of said key assembly together for movement as a unit;

(B) a flexible, light-transmitting keypad secured to said first end of said key assembly for movement therewith; and (C) an electrical contact secured to said keypad for movement therewith.

2. The assembly of claim 1 wherein said electrical contact is disposed adjacent said first end of said opaque member.

3. The assembly of claim 1 wherein said key assembly and said keypad are rubber.

4. The assembly of claim 1 wherein said opaque member includes a recess opening toward said first end and to said one side, and said fusing member defines a lug occupying said recess and extending towards said second end.

5. The assembly of claim 1 wherein said keypad is resiliently flexible.

6. The assembly of claim 1 wherein said light-transmitting member defines a belt at said first end extending about a cross-section of said first end of said opaque member.

7. The assembly of claim 6 wherein the outer surface of said belt is flush with the outer surface of said opaque member.

8. In combination, the assembly of claim 1 and a board disposed at least adjacent said first end of said keypad and said electrical contact, said board including a light source disposed at least partially adjacent said first end of said keypad to illuminate said light-transmitting member and an open electrical circuit adapted to be closed by said electrical contact when said keypad is flexed towards said first end.

9. The combination of claim 8 wherein said light source is disposed in direct alignment with and adjacent said first end of said light-transmitting member.

10. The combination of claim 8 wherein said light source is a light-emitting diode.

11. The combination of claim 8 wherein said electrical contact is disposed adjacent said first end of said opaque member.

12. The combination of claim 11 wherein said electrical contact is opaque.

13. A switch assembly and board construction comprising:

(A) a back-lit key assembly having first and second opposed ends and including (i) an opaque member defining an outer surface, (ii) a light-transmitting member lightable from said first end disposed at least partially to one side thereof, and (iii) a fusing member securing said light-transmitting and opaque members of said key assembly together, said light-transmitting member defining a belt at said first end thereof extending about a cross-section of said first end of said opaque member and defining an outer surface, the outer surface of said belt being flush with the outer surface of said opaque member, said opaque member including a recess opening towards said first end and to said one side, said fusing member defining a lug occupying said recess and extending towards said second end;

(B) a resiliently flexible, electrically insulative, light-transmitting keypad disposed at least partially adjacent said first end of said key assembly and secured thereto for movement as a unit;

(C) an electrical contact secured to said keypad adjacent said first end of said opaque member for movement therewith; and (D) a board disposed at least partially adjacent said first end of said keypad and said electrical contact, said board including a light source disposed in direct alignment with and beyond said first end of said light-transmitting member and an open electrical circuit adapted to be closed by said electrical contact when said keypad is flexed towards said first end.

14. A keypad assembly adapted to be back-lit from a back end thereof, comprising:

(A) an opaque member defining an outer surface;

(B) a light-transmitting member lightable from said back end disposed at least partially to one side of said opaque member; and (C) a light-transmitting fusing member securing said light-transmitting and opaque members together with said fusing member for movement as a unit.

15. The assembly of claim 14 wherein said opaque member includes a recess opening toward said back end and to said one side, and said fusing member defines a lug occupying said recess and extending oppositely from said back end.

16. The assembly of claim 14 wherein said assembly is formed of rubber.

17. A switch assembly comprising the key assembly of claim 14, a flexible, transparent keypad secured adjacent said back end of said key assembly for movement therewith, and an electrical contact secured to said keypad for movement therewith.

18. The assembly of claim 14 wherein said light-transmitting member defines a belt adjacent said back end extending about a cross-section of said back end of said opaque member and defining an outer surface.

19. The assembly of claim 18 wherein the outer surface of said belt is flush with the outer surface of said opaque member.

20. A key assembly adapted to be back-lit from a back end thereof comprising:

(A) an opaque member defining a recess opening toward said back end and on one side;

(B) a light-transmitting member lightable from said back end and abutting said one side, said light-transmitting member defining a belt at said back end thereof extending about a cross section of said back end of said opaque member and having an outer surface flush with the outer surface of said opaque member; and (C) a fusing member securing said light-transmitting and opaque members together with said fusing member for movement as a unit, said fusing member defining a lug extending oppositely from said back end into said recess and joining said opaque and light-transmitting members at said one side.

* * * * *